US008070885B2

(12) United States Patent
Busatto

(10) Patent No.: US 8,070,885 B2
(45) Date of Patent: Dec. 6, 2011

(54) QUENCHING FLUID

(75) Inventor: Didier Busatto, Petit Couronne (FR)

(73) Assignee: Shell Oil Company, Houston, TX (US)

( * ) Notice: Subject to any disclaimer, the term of this patent is extended or adjusted under 35 U.S.C. 154(b) by 876 days.

(21) Appl. No.: 11/920,460

(22) PCT Filed: Dec. 7, 2005

(86) PCT No.: PCT/EP2006/056565

§ 371 (c)(1),
(2), (4) Date: May 13, 2008

(87) PCT Pub. No.: WO2006/122585

PCT Pub. Date: Nov. 23, 2006

(65) Prior Publication Data

US 2009/0308505 A1 Dec. 17, 2009

(30) Foreign Application Priority Data

May 19, 2005 (EP) ..... 05291075

(51) Int. Cl.
*C21D 1/58* (2006.01)
*C07C 5/13* (2006.01)
*C07C 9/22* (2006.01)

(52) U.S. Cl. ..... 148/29; 148/637; 585/2; 585/734

(58) Field of Classification Search ..... None
See application file for complete search history.

(56) References Cited

U.S. PATENT DOCUMENTS

| | | | | |
|---|---|---|---|---|
| 3,567,640 | A | 3/1971 | Stroh | 252/59 |
| 4,943,672 | A | 7/1990 | Hamner et al. | 585/737 |
| 5,059,299 | A | 10/1991 | Cody et al. | 208/27 |
| 5,853,564 | A * | 12/1998 | Ackerson et al. | 208/33 |
| 6,239,082 | B1 | 5/2001 | Hewson et al. | 508/287 |
| 2002/0033247 | A1 * | 3/2002 | Neuschutz et al. | 165/10 |
| 2004/0065581 | A1 | 4/2004 | Jiang et al. | 208/18 |
| 2005/0208286 | A1 * | 9/2005 | Hartmann et al. | 428/292.1 |

FOREIGN PATENT DOCUMENTS

| | | |
|---|---|---|
| DE | 4120036 | 12/2002 |
| EP | 324528 | 7/1989 |
| EP | 582347 | 2/1994 |
| EP | 668342 | 8/1995 |
| EP | 776959 | 6/1997 |
| WO | WO9201657 | 2/1992 |
| WO | WO9220759 | 11/1992 |
| WO | WO9410264 | 5/1994 |
| WO | WO9920720 | 4/1999 |
| WO | WO9934917 | 7/1999 |
| WO | WO03052146 | 6/2003 |

OTHER PUBLICATIONS

International Search Report dated Apr. 7, 2006 (PCT/EP2005/056565).

* cited by examiner

*Primary Examiner* — George Wyszomierski

(57) ABSTRACT

Quenching fluid composition comprising one or more additives and a saturated base oil having a kinematic viscosity at 100° C. "K" expressed in centistokes and a viscosity index "I" wherein I is greater than 120 and K greater than 2 cSt.

9 Claims, No Drawings

QUENCHING FLUID

PRIORITY CLAIM

The present application claims priority to European Patent Application 05291075.9 filed 19 May 2005.

FIELD OF INVENTION

The invention is directed to a quenching fluid and its use.

BACKGROUND OF THE INVENTION

Desired hardness and strength properties of metals, particularly ferrous metals and especially metal alloys such as carbon steel and alloy steel, are secured by heat treatment of the metal object. The properties usually depend upon establishment of certain physical structures in the metal. The production of the desired physical structures is obtained by heating the metal to a temperature where the structure is present, then by arresting at the desired point the changes in the internal structure which take place during cooling of the metal from high temperatures. Quick cooling by quenching the heated object in a quenching medium makes it possible to arrest the physical changes at the desired point during cooling.

Quenching in the quenching medium is carried out in such a manner that the physical changes in the metal are arrested at the desired point, usually at the point at which maximum hardness is obtained. Subsequently, the heat treated and quenched object may be subjected to treatment at lower temperature (annealing or tempering) to provide the desired degree of toughness and ductility.

For many years mineral oil based quenching fluids have been used. Previously, aqueous quenching media were employed. The aqueous fluids provided extremely rapid cooling setting up excessive amounts of internal stress in the object. Mineral oil based fluids avoided this difficulty. Quenching fluids should in use be stable for a prolonged period at relatively high temperatures. A common problem of oil based fluids is that during use sludge will form which tends to stick to the metal object.

Publications which deal with the problem of sludge formation are for example WO-A-03052146 and U.S. Pat. No. 6,239,082. WO-A-03052146 describes a quenching fluid consisting of an oil and an alkali metal salt derivative. The examples of WO-A-03052146 disclose quenching fluids containing at least a mineral oil, para-dodecyl phenol and polyisobutylene. U.S. Pat. No. 6,239,082 describes a quench oil consisting of a mineral oil, polyisobutylene and polyisobutylene succinic anhydride. These publications show that the mineral oil needs to be combined with para-dodecyl phenol in order to improve oxidation stability and avoid sludge formation. Poly iso butylenes are added to improve the cooling capacity of the fluid.

SUMMARY OF THE INVENTION

The present invention provides a more simple quenching fluid which does not form a sludge or at least forms in use said sludge in a significantly lower rate than the known mineral oil quenching fluids or quenching fluids based on mineral oils.

The quenching fluid composition comprises one or more additives and a saturated base oil having a kinematic viscosity at 100° C. "K" expressed in centistokes and a viscosity index "I" wherein I is greater than 120 and K greater than 2 cSt.

DETAILED DESCRIPTION OF THE INVENTION

It was found that the combination of a high viscosity index and a high degree of saturation provides a fluid, which does not form a sludge. A further advantage is that a fluid is obtained having an improved cooling capacity. This is advantageous because less of the traditional fluids, like polyisobutylenes need to be added to obtain the same cooling capacity.

The quenching fluid composition comprises a base oil. It is especially the base oil component of the fluid which will determine if a sludge will form or not. Applicant found that by choosing a particular base oil sludge formation can be minimized. The base oil thus has a kinematic viscosity at 100° C. "K" expressed in centistokes and a viscosity index "I" wherein I is greater than 120, and preferably between 135 and 150 and K greater than 2 cSt, more preferably between 3.5 and 30 cSt. It has further been found that the viscosity index and the viscosity of the base oil is preferably according to the following relation wherein K is smaller than 0.5*I-60 ($K<0.5*I-60$).

The base oil preferably has a pour point of below −5° C., and preferably below −20° C. according to ASTM D 5950. The pour point of the base oil will depend also on its viscosity. Higher viscosity base oils may have higher pour points than the lower viscosity base oils. For illustration purposes only different viscosity grade base oils isolated by distillation from a wide boiling dewaxed oil may have different pour points wherein the lower viscosity grade base oils will typically have the lowest pour point. The base oil has preferably a flash point of more than 170° C., preferably more than 190° C., most preferably more than 200° C., according to ASTM D 92. The saturates content of the base oil as measured by IP386 is preferably greater than 98 wt %, more preferably greater than 99 wt % and even more preferably greater than 99.5 wt % as measured on fresh base oil.

The base oil comprises of a series of iso-paraffins having n, n+1, n+2, n+3 and n+4 carbon atoms and wherein n is a number between 20 and 40. It has been found that these base oils on the one hand have the favorable reduced sludge forming capabilities and on the other hand are easily obtained from a paraffinic wax as will be described further below. The presence of such a continuous series may be measured by Field desorption/Field Ionisation (FD/FI)technique. In this technique the oil sample is first separated into a polar (aromatic) phase and a non-polar (saturates) phase by making use of a high performance liquid chromatography (HPLC) method IP368/01, wherein as mobile phase pentane is used instead of hexane as the method states. The saturates and aromatic fractions are then analyzed using a Finnigan MAT90 mass spectrometer equipped with a Field desorption/Field Ionisation (FD/FI) interface, wherein FI (a "soft" ionisation technique) is used for the determination of hydrocarbon types in terms of carbon number and hydrogen deficiency. The type classification of compounds in mass spectrometry is determined by the characteristic ions formed and is normally classified by "z number". This is given by the general formula for all hydrocarbon species: $C_nH_{2n+z}$. Because the saturates phase is analysed separately from the aromatic phase it is possible to determine the content of the different iso-paraffins having the same stoichiometry or n-number. The results of the mass spectrometer are processed using commercial software (poly 32; available from Sierra Analytics LLC, 3453 Dragoo Park Drive, Modesto, Calif. GA95350 USA) to determine the relative proportions of each hydrocarbon type.

The base oil is preferably obtained by hydroisomerisation of a paraffinic wax, preferably followed by some type of dewaxing, such as solvent or catalytic dewaxing. The paraffinic wax may be a slack wax. More preferably the paraffinic wax is a Fischer-Tropsch derived wax, because of its purity and high paraffinic content. An examples of a process involving solvent dewaxing a Fischer-Tropsch derived isomerized wax feed is described in U.S. Pat. No. 4,943,672.

Examples of Fischer-Tropsch processes which for example can be used to prepare the above-described Fischer-Tropsch derived base oil are the so-called commercial Slurry Phase Distillate technology of Sasol, the Shell Middle Distillate Synthesis Process and the "AGC-21" Exxon Mobil process. These and other processes are for example described in more detail in EP-A-776 959, EP-A-668 342, U.S. Pat. Nos. 4,943,672, 5,059,299, WO-A-9934917 and WO-A-9920720. Typically these Fischer-Tropsch synthesis products will comprise hydrocarbons having 1 to 100 and even more than 100 carbon atoms. This hydrocarbon product will comprise normal paraffins, iso-paraffins, oxygenated products and unsaturated products. If base oils are one of the desired iso-paraffinic products it may be advantageous to use a relatively heavy Fischer-Tropsch derived feed. The relatively heavy Fischer-Tropsch derived feed has at least 30 wt %, preferably at least 50 wt %, and more preferably at least 55 wt % of compounds having at least 30 carbon atoms. Furthermore the weight ratio of compounds having at least 60 or more carbon atoms and compounds having at least 30 carbon atoms of the Fischer-Tropsch derived feed is preferably at least 0.2, more preferably at least 0.4 and most preferably at least 0.55. Preferably the Fischer-Tropsch derived feed comprises a $C_{20}^{+}$ fraction having an ASF-alpha value (Anderson-Schulz-Flory chain growth factor) of at least 0.925, preferably at least 0.935, more preferably at least 0.945, even more preferably at least 0.955. Such a Fischer-Tropsch derived feed can be obtained by any process, which yields a relatively heavy Fischer-Tropsch product as described above. Not all Fischer-Tropsch processes yield such a heavy product. An example of a suitable Fischer-Tropsch process is described in WO-A-9934917.

The Fischer-Tropsch derived product will contain no or very little sulphur and nitrogen containing compounds. This is typical for a product derived from a Fischer-Tropsch reaction, which uses synthesis gas containing almost no impurities. Sulphur and nitrogen levels will generally be below the detection limits, which are currently 5 ppm for sulphur and 1 ppm for nitrogen respectively.

The process will generally comprise a Fischer-Tropsch synthesis, a hydroisomerisation step and an optional pour point reducing step, wherein said hydroisomerisation step and optional pour point reducing step are performed as:

(a) hydrocracking/hydroisomerisating a Fischer-Tropsch product, (b) separating the product of step (a) into at least one or more distillate fuel fractions and a base oil or base oil intermediate fraction.

If the viscosity and pour point of the base oil as obtained in step (b) is as desired no further processing is necessary and the oil can be used as the base oil according the invention. If required, the pour point of the base oil intermediate fraction is suitably further reduced in a step (c) by means of solvent or preferably catalytic dewaxing of the oil obtained in step (b) to obtain oil having the preferred low pour point. The desired viscosity of the base oil may be obtained by isolating by means of distillation from the intermediate base oil fraction or from the dewaxed oil the a suitable boiling range product corresponding with the desired viscosity. Distillation may be suitably a vacuum distillation step.

The hydroconversion/hydroisomerisation reaction of step (a) is preferably performed in the presence of hydrogen and a catalyst, which catalyst can be chosen from those known to one skilled in the art as being suitable for this reaction of which some will be described in more detail below. The catalyst may in principle be any catalyst known in the art to be suitable for isomerising paraffinic molecules. In general, suitable hydroconversion/hydroisomerisation catalysts are those comprising a hydrogenation component supported on a refractory oxide carrier, such as amorphous silica-alumina (ASA), alumina, fluorided alumina, molecular sieves (zeolites) or mixtures of two or more of these. One type of preferred catalysts to be applied in the hydroconversion/hydroisomerisation step in accordance with the present invention are hydroconversion/hydroisomerisation catalysts comprising platinum and/or palladium as the hydrogenation component. A very much preferred hydroconversion/hydroisomerisation catalyst comprises platinum and palladium supported on an amorphous silica-alumina (ASA) carrier. The platinum and/or palladium is suitably present in an amount of from 0.1 to 5.0% by weight, more suitably from 0.2 to 2.0% by weight, calculated as element and based on total weight of carrier. If both present, the weight ratio of platinum to palladium may vary within wide limits, but suitably is in the range of from 0.05 to 10, more suitably 0.1 to 5. Examples of suitable noble metal on ASA catalysts are, for instance, disclosed in WO-A-9410264 and EP-A-0 582 347. Other suitable noble metal-based catalysts, such as platinum on a fluorided alumina carrier, are disclosed in e.g. U.S. Pat. No. 5,059,299 and WO-A-9220759.

A second type of suitable hydroconversion/hydroisomerisation catalysts are those comprising at least one Group VIB metal, preferably tungsten and/or molybdenum, and at least one non-noble Group VIII metal, preferably nickel and/or cobalt, as the hydrogenation component. Both metals may be present as oxides, sulphides or a combination thereof. The Group VIB metal is suitably present in an amount of from 1 to 35% by weight, more suitably from 5 to 30% by weight, calculated as element and based on total weight of the carrier. The non-noble Group VIII metal is suitably present in an amount of from 1 to 25 wt %, preferably 2 to 15 wt %, calculated as element and based on total weight of carrier. A hydroconversion catalyst of this type which has been found particularly suitable is a catalyst comprising nickel and tungsten supported on fluorided alumina.

The above non-noble metal-based catalysts are preferably used in their sulphided form. In order to maintain the sulphided form of the catalyst during use some sulphur needs to be present in the feed. Preferably at least 10 ppm and more preferably between 50 and 150 ppm of sulphur is present in the feed.

A preferred catalyst, which can be used in a non-sulphided form, comprises a non-noble Group VIII metal, e.g., iron, nickel, in conjunction with a Group IB metal, e.g., copper, supported on an acidic support. Copper is preferably present to suppress hydrogenolysis of paraffins to methane. The catalyst has a pore volume preferably in the range of 0.35 to 1.10 ml/g as determined by water absorption, a surface area of preferably between 200-500 $m^2/g$ as determined by BET nitrogen adsorption, and a bulk density of between 0.4-1.0 g/ml. The catalyst support is preferably made of an amorphous silica-alumina wherein the alumina may be present within wide range of between 5 and 96 wt %, preferably between 20 and 85 wt %. The silica content as $SiO_2$ is preferably between 15 and 80 wt %. Also, the support may contain small amounts, e.g., 20-30 wt %, of a binder, e.g., alumina, silica, Group IVA metal oxides, and various types of clays, magnesia, etc., preferably alumina or silica.

The preparation of amorphous silica-alumina microspheres has been described in Ryland, Lloyd B., Tamele, M.

W., and Wilson, J. N., Cracking Catalysts, Catalysis: volume VII, Ed. Paul H. Emmett, Reinhold Publishing Corporation, New York, 1960, pp. 5-9.

The catalyst is prepared by co-impregnating the metals from solutions onto the support, drying at 100-150° C., and calcining in air at 200-550° C. The Group VIII metal is present in amounts of about 15 wt % or less, preferably 1-12 wt %, while the Group IB metal is usually present in lesser amounts, e.g., 1:2 to about 1:20 weight ratio respecting the Group VIII metal.

A typical catalyst is shown below:

| | |
|---|---|
| Ni, wt % | 2.5-3.5 |
| Cu, wt % | 0.25-0.35 |
| $Al_2O_3$—SiO2 wt % | 65-75 |
| $Al_2O_3$ (binder) wt % | 25-30 |
| Surface Area | 290-325 $m^2/g$ |
| Pore Volume (Hg) | 0.35-0.45 ml/g |
| Bulk Density | 0.58-0.68 g/ml |

Another class of suitable hydroconversion/hydroisomerisation catalysts are those based on zeolitic materials, suitably comprising at least one Group VIII metal component, preferably Pt and/or Pd, as the hydrogenation component. Suitable zeolitic and other aluminosilicate materials, then, include Zeolite beta, Zeolite Y, Ultra Stable Y, ZSM-5, ZSM-12, ZSM-22, ZSM-23, ZSM-48, MCM-68, ZSM-35, SSZ-32, ferrierite, mordenite and silica-aluminophosphates, such as SAPO-11 and SAPO-31. Examples of suitable hydroisomerisation/hydroisomerisation catalysts are, for instance, described in WO-A-9201657. Combinations of these catalysts are also possible. Very suitable hydroconversion/hydroisomerisation processes are those involving a first step wherein a zeolite beta based catalyst is used and a second step wherein a ZSM-5, ZSM-12, ZSM-22, ZSM-23, ZSM-48, MCM-68, ZSM-35, SSZ-32, ferrierite, mordenite based catalyst is used. Of the latter group ZSM-23, ZSM-22 and ZSM-48 are preferred. Examples of such processes are described in US-A-20040065581, which disclose a process comprising a first step catalyst comprising platinum and zeolite beta and a second step catalyst comprising platinum and ZSM-48.

In step (a) the feed is contacted with hydrogen in the presence of the catalyst at elevated temperature and pressure. The temperatures typically will be in the range of from 175 to 380° C., preferably higher than 250° C. and more preferably from 300 to 370° C. The pressure will typically be in the range of from 10 to 250 bar and preferably between 20 and 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg.

The conversion in step (a) as defined as the weight percentage of the feed boiling above 370° C. which reacts per pass to a fraction boiling below 370° C., is at least 20 wt %, preferably at least 25 wt %, but preferably not more than 80 wt %, more preferably not more than 65 wt %. The feed as used above in the definition is the total hydrocarbon feed fed to step (a), thus also any optional recycle of a high boiling fraction which may be obtained in step (b).

In step (b) the product of step (a) is preferably separated into one or more distillate fuels fractions and a base oil or base oil precursor fraction having the desired viscosity properties. If the pour point is not in the desired range the pour point of the base oil is further reduced by means of a dewaxing step (c), preferably by catalytic dewaxing. In such an embodiment it may be a further advantage to dewax a wider boiling fraction of the product of step (a). From the resulting dewaxed product the base oil and oils having a desired viscosity can then be advantageously isolated by means of distillation. The final boiling point of the feed to the dewaxing step (c) may be up to the final boiling point of the product of step (a).

The quenching fluid composition comprises the above base oil and one or more additives. In addition the fluid may comprise other base oils as the one described above. These other base oils may be mineral derived base oils not having the above properties or so-called poly-alpha olefin base oils. However in order to benefit the most from the advantages of the present invention the base oil component in the fluid is preferably for more than 80 wt %, more preferably for more than 90 wt % and most preferably for 100% a base oil as described above. Small amounts of a poly alpha olefin oligomer type base oil may optionally be present, preferably less than 10 wt % and more preferably less than 5 wt % as measured over the quenching oil fluid itself.

The additives which may be present are those well known to the skilled person. Reference is made to chapter 11.13.8 of a general textbook titled 'Lubricants and related products', by Dieter Klamann, Verlag Chemie, 1984, ISBN 3-527-26022-6, pages 376-383. Preferably the fluid comprises an anti-foam additive, which may be a silicon based or non-silicon based type additive, heating curve additives which improve the cooling speed of the fluid, for example a high molecular sodium sulfonate additive optionally in admixture with a high molecular weight succinic acid additive, and a dispersant, for example calcium alkyl salicilate additives.

The quenching fluid is preferably used in the below quenching process. The quenching process modifies the structure of steel, an iron-carbon alloy, so as to give it certain desired mechanical properties. A quenching process comprises the steps of (i) heating to and keeping at that temperature the steel object such that the austenitic structure is obtained and (ii) rapidly cooling the object in the quenching fluid until the martensitic crystalline structure is obtained. Step (i) may be performed applying a temperature cycle and in a specific gaseous atmosphere, for example $CH_4$, $C_3H_8$, $CH_3OH$ or $N_2$, known to the skilled person. Step (ii) is preferably performed in a so-called quenching bath into which the object is submerged in the quenching fluid. The bath will consist of a tank in which the quenching fluid is maintained at a given temperature, with or without stirring. This tank is designed so as to enable the necessary maintenance operations, such as filtration, tank draining and complete cleaning of the facility. The tank suitably also has a heat-exchange system for temperature regulation.

The properties of the steel object will determine the optimal quenching operation. Steel is an iron/carbon alloy. Each steel is characterized by its carbon content and by the possible addition of other elements. Hardenability, that is the capacity of the steel to react to quenching, will vary as a function of these properties. Furthermore the thickness, length and volume of the object will influence the choice of the quenching conditions.

There exist three main categories of the above quenching process, Cold quenching, Mixed quenching and Hot quenching.

In a Cold quenching process according to the present invention the quenching fluid is kept at a temperature of below 80° C. The kinematic viscosity at 100° C. of the preferred Fischer-Tropsch derived base oil which is part of the quenching fluid composition is preferably between 3.5 and 7.5 cSt to achieve a low consumption of the quenching fluid. Cold quenching is preferred for steels of good hardenability and commonly used for bearings and small parts.

In a Mixed quenching process according to the present invention the quenching fluid is kept at a temperature of between 80 and 120° C. The kinematic viscosity at 100° C. of the of the preferred Fischer-Tropsch derived base oil which is part of the quenching fluid composition is preferably between 7.5 and 12 cSt to achieve a low consumption of the quenching fluid. Mixed or sometimes also referred to as Warm quenching is preferred for plain carbon or low-alloy steels and allows a good compromise between deepness of hardening and object distortion.

In a Hot quenching, also referred to as 'marquenching', according to the present invention the quenching fluid is kept at a temperature of between 120 and 180° C. The kinematic viscosity at 100° C. of the of the preferred Fischer-Tropsch derived base oil which is part of the quenching fluid composition is preferably between 12 and 30 cSt. Hot quenching is preferred for steels of low hardenability and commonly used for gears. Hot quenching achieves little dimensional change in the object and reduced distortion.

The invention will be illustrated by the following non-limiting examples.

EXAMPLE 1

Three quenching fluid compositions were made using a Fischer-Tropsch derived base oil and two mineral derived base oils. The compositions consisted of 95 wt % of the base oil and 5 wt % of a standard additive package consisting of a high molecular weight succinic acid additive, a high molecular sodium sulfonate additive, a calcium alkyl salicilate and a silicon based antifoam additive.

The two mineral derived base oils had the properties as listed in Table 2. The Fischer-Tropsch derived base oil was made according to the below.

From residue "R" as obtained according to Example 1 of EP-A-1 366 135 a Fischer-Tropsch derived distillation fraction was isolated having the properties as listed in Table 1. The wax content was 27.1 wt % as determined after solvent dewaxing at a dewaxing temperature of −27° C.

TABLE 1

| Feed to catalytic dewaxing | |
|---|---|
| Congealing point | 45° C. |
| Density at 70° C. | 0.796 |
| IBP wt % distilled | 362° C. |
| 10 | 412° C. |
| 50 | 462° C. |
| 70 | 487° C. |
| 90 | 519° C. |
| FBP | 573° C. |

The above distillate fraction was contacted with a dewaxing catalyst consisting of 0.7 wt % platinum, 25 wt % ZSM-12 and a silica binder. The dewaxing conditions were 40 bar hydrogen, WHSV=1.0 kg/l.h, and a hydrogen gas rate of 500 Nl/kg feed and a temperature of 315° C. From the dewaxed oil a base oil fraction was isolated by distillation having the properties as listed in Table 2.

TABLE 2

| | Base Oils | | |
|---|---|---|---|
| | Fischer-Tropsch derived | Mineral base oil A | Mineral base oil B |
| Density at 15° C. IP365/97 (kg/m$^3$) | 820.7 | 854 | 864 |
| Viscosity Index ASTM D 2270 | 144 | 109 | 108 |
| Kinematic Viscosity @ 40° C. ASTM D 445 (mm$^2$/s) | 24.52 | 19.33 | 23.3 |
| Kinematic Viscosity @ 100° C. ASTM D445 (mm$^2$/s) | 5.143 | 4.061 | 4.505 |
| Noack Volatility (at 150° C.) CEC L40 A93, (%) | 8.95 | Not measured | 17.6 |
| Pour point ASTM D 97 (° C.) | −24 | −18 | −15 |
| 0.5*I (Viscosity Index)60 | 12 | −5.5 | −7.5 |

The three base oils and the three quenching fluid formulations were tested under the same conditions wherein through 300 ml of the fluid present in a glass beaker 10 normal liter per hour of air was passed for a total of 96 hours at a temperature of 180° C. The viscosity of the base oils and fluids as well as their appearance were measured/observed. The results are presented in Table 3.

In Table 3 sludge was observed for base oil B and for the quenching fluid based on base oil B. For base oil A a black colour was observed. No sludge formation was observed but it is believed that the black colour is indicative for suspension of thin sludges. The Fischer-Tropsch derived base oil and quenching fluid based on said base oil showed no sludge formation and no darkening of the fluid. The liquid had after 96 hours of testing a clear to dark orange appearance. Based on these results it can be concluded that the quenching fluid according to the present invention is suited for its intended use.

TABLE 3

| | | | | Formulated Quenching fluid | | |
|---|---|---|---|---|---|---|
| Product reference | Fischer-Tropsch derived base oil | Mineral base oil A | Mineral base oil B | Fischer-Tropsch derived base oil | Mineral base oil A | Mineral base oil B |
| viscosity at 40° C. 0 Hour | 24.57 | 19.01 | 23.38 | 31.84 | 25.66 | 32.46 |
| viscosity at 40° C. 24 H | 30.79 | 23.87 | 25.01 | | 26.54 | 32.64 |
| viscosity at 40° C. 48 H | 41.86 | 30.19 | 29.48 | 34.62 | 30.69 | 38.07 |
| viscosity at 40° C. 72 H | 64.56 | 36.48 | 32.62 | 41.15 | 36.08 | 52.43 |
| viscosity at 40° C. 96 H | 72.03 | 45.21 | 35.94 | 48.12 | 37.15 | Sludge |
| % Variation visco at 0 H | 0 | 0 | 0 | 0 | 0 | 0 |
| Variation visco at 24 H | 25.31 | 25.57 | 6.99 | | 3.44 | 0.57 |
| Variation visco at 48 H | 70.37 | 58.83 | 26.09 | 8.71 | 19.63 | 17.28 |
| Variation visco at 72 H | 162.77 | 91.92 | 39.53 | 29.24 | 40.60 | 61.51 |

TABLE 3-continued

| | | | | Formulated Quenching fluid | | |
|---|---|---|---|---|---|---|
| Product reference | Fischer-Tropsch derived base oil | Mineral base oil A | Mineral base oil B | Fischer-Tropsch derived base oil | Mineral base oil A | Mineral base oil B |
| Variation visco at 96 H | 193.18 | 137.86 | 53.74 | 51.10 | 44.80 | Sludge |
| observations during the test | Orange clear | Black | Black | Orange dark | Black | Black |
| Amount of Sludge | 0 | 0 | +++ | None | none | ++++++ |

What is claimed is:

1. A quenching fluid composition comprising one or more additives including a heating curve additive and a saturated base oil having a kinematic viscosity "K" at 100° C. greater than 2 cSt and a viscosity index "I" according to ASTM D 2270 greater than 120, and wherein the base oil comprises a series of iso-paraffins having n, n+1, n+2, n+3 and n+4 carbon atoms and wherein n is a number between 20 and 40.

2. A composition according to claim 1, wherein the viscosity index is between 135 and 150.

3. A composition according to claim 1, wherein the kinematic viscosity is between 3.5 and 30 cSt.

4. A composition according to claim 1, wherein $K<0.5*I-60$.

5. A composition according to claim 1, wherein the base oil has a flash point of more than 190° C.

6. A composition according to claim 1, wherein the base oil has a saturates content of greater than 99 wt %.

7. A composition according to claim 1, wherein the base oil is obtained by hydroisomerisation of a Fischer-Tropsch derived wax, followed by dewaxing.

8. A composition according to claim 1, wherein the content of the base oil is greater than 80 wt %.

9. A composition according to claim 1, wherein the additives comprise an anti-foam additive and a dispersant.

* * * * *